US009687708B2

(12) United States Patent
Bennett

(10) Patent No.: US 9,687,708 B2
(45) Date of Patent: Jun. 27, 2017

(54) COMBINATION DEVICE AND SYSTEM FOR COOLING ITEMS AND PLAYING BAG TOSS GAME, AND METHOD OF ASSEMBLY AND USE THEREOF

(71) Applicant: Robert Bennett, McLean, VA (US)

(72) Inventor: Robert Bennett, McLean, VA (US)

( * ) Notice: Subject to any disclaimer, the term of this patent is extended or adjusted under 35 U.S.C. 154(b) by 0 days.

(21) Appl. No.: 14/086,592

(22) Filed: Nov. 21, 2013

(65) Prior Publication Data

US 2014/0151963 A1 Jun. 5, 2014

Related U.S. Application Data

(60) Provisional application No. 61/729,090, filed on Nov. 21, 2012.

(51) Int. Cl.

| | |
|---|---|
| ***A63B 67/06*** | (2006.01) |
| ***A63B 63/08*** | (2006.01) |
| ***A63B 71/00*** | (2006.01) |

(52) U.S. Cl.

CPC ..... *A63B 67/06* (2013.01); *A63B 63/08* (2013.01); *A63B 71/0036* (2013.01); *A63B 2225/66* (2013.01); *Y10T 29/49359* (2015.01)

(58) Field of Classification Search

CPC . A63B 67/06; B65D 1/04; B65D 1/20; B65D 1/38; B65D 5/16; B65D 1/323; A63F 7/042

USPC ..... 273/398, 400, 399, 401, 402; 62/457.1, 62/457.4, 457.7; 312/36; 463/3

See application file for complete search history.

(56) References Cited

U.S. PATENT DOCUMENTS

| | | | | |
|---|---|---|---|---|
| 1,154,136 | A * | 9/1915 | Simao | 273/153 R |
| 3,696,549 | A * | 10/1972 | Zilius | 446/168 |
| 6,568,679 | B1 * | 5/2003 | Sommer | A63F 7/042 273/118 R |
| 7,963,397 | B2 * | 6/2011 | Seagle et al. | 206/600 |
| 8,764,017 | B2 * | 7/2014 | Manner et al. | 273/400 |
| 8,867,235 | B2 * | 10/2014 | Veillette | H02G 3/083 174/559 |
| 2006/0125186 | A1 * | 6/2006 | Digges et al. | 273/402 |

* cited by examiner

*Primary Examiner* — Aarti B Berdichevsky
*Assistant Examiner* — Rayshun Peng
(74) *Attorney, Agent, or Firm* — Arent Fox LLP

(57) ABSTRACT

A bean bag or other item toss device, system, and method that includes a housing having an angled top surface with an opening in the top surface, as well as a method of construction thereof. In some versions, at least a portion of the top surface may be opened or removed to allow access to a cooling area therebeneath. The opening in the top surface may include a passage or conduit so as to allow items tossed thereinto to pass through the cooling area to an open space beneath the device, allowing retrieval of the tossed item, without the tossed item having contacted the interior of the cooling area.

17 Claims, 2 Drawing Sheets

COMBINATION DEVICE AND SYSTEM FOR COOLING ITEMS AND PLAYING BAG TOSS GAME, AND METHOD OF ASSEMBLY AND USE THEREOF

This application claims priority to U.S. Provisional Patent Application No. 61/729,090 filed Nov. 21, 2012, the entire contents of which are hereby incorporated by reference herein.

FIELD OF THE INVENTION

Aspects of the invention relate to components of a device, system, and method for playing of a game involving tossing bagged items and for providing for cooling of beverages and other items, and to construction and use of such device.

BACKGROUND OF THE TECHNOLOGY

There remains an unmet need to provide a device, system, and method for playing a bag toss game that combines such game play features with cooling features, such as for cooling beverages and other items.

SUMMARY OF THE INVENTION

Aspects of the present invention provide a device, system, and method for receiving tossed beanbags or other items and for also providing a cooling storage area for storage and retrieval of cooled items, such as beverages. The device for receiving tossed items includes an angled surface portion having an opening for receiving items tossed so as to enter the opening. In one variation, the opening extends through the cooling storage area.

In some variations, the angled surface portion is supported by one or more legs, and the cooling storage area is accessed via removal or pivoting of at least a part of the angled surface portion.

Additional advantages and novel features relating to aspects of the present invention will be set forth in part in the description that follows, and in part will become more apparent to those skilled in the art upon examination of the following or upon learning by practice thereof.

BRIEF DESCRIPTION OF THE DRAWINGS

Aspects of the present invention will become fully understood from the detailed description given herein below and the accompanying drawings, which are given by way of illustration and example only and thus not limited to aspects of the present invention shown, wherein.

DETAILED DESCRIPTION

It is known in the related art to provide a beanbag or other item toss game, in which the beanbag is tossed onto an angled surface having a hole or opening therein, in an attempt to get the tossed item to enter the opening. Multiple competitive tosses of an item may occur from preset distances, with scoring occurring in a number of ways, such as by counting the number of tossed items entering the opening for each competitor. Tossed items that do not directly enter the opening may slide down the angled surface, either to later enter the opening (if contacting the angled surface at a point up angle from the opening), or the sliding items may slide to the bottom or off the angled surface.

In the related art games, typically after each tossing round, items may be retrieved from beneath the opening. Access beneath the opening may be accomplished, for example, by angling the top surface using one or more supporting legs. Items entering the opening fall beneath the angled surface and may be retrieved from the unobstructed sides of the device, for example.

The toss game of the related art is typically played outside and may be accompanied by drinking of beverages or eating of foods, each of which may need to be cooled. Aspects of the present invention enhance the game play experience by providing for a cooling area located within the device of the game that does not obstruct or interfere with standard play of the game.

Aspects of the present invention include a bean bag or other item toss device, system, and method that include a housing having an angled top surface with an opening in the top surface, and methods of assembly thereof. In some variations, at least a portion of the top surface may be opened or removed to allow access to a cooling area therebeneath. In some variations, the opening in the top surface includes a passage or conduit so as to allow items tossed thereinto to pass through the cooling area to an open space beneath the device, allowing retrieval of the tossed item, without the tossed item having contacted the interior of the cooling area.

Figure 1:
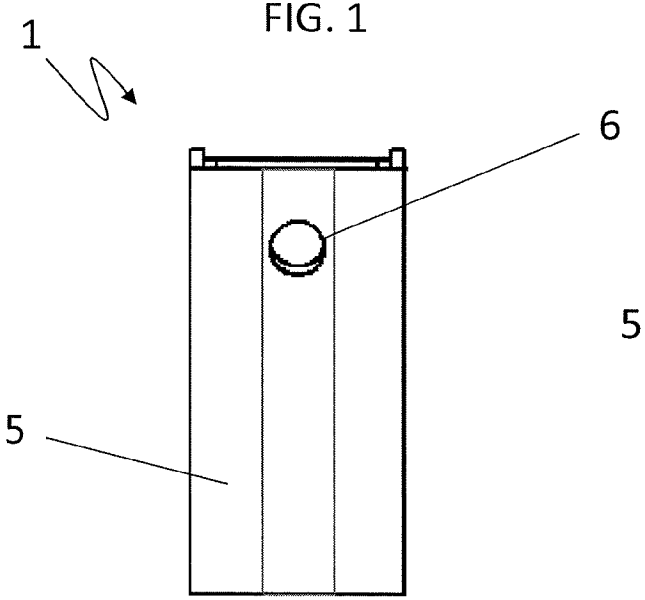
FIG. 1 shows a first overhead view of an example device for receiving tossed items and for storage of cooled items, with an angled top surface of the device shown in a closed position, in accordance with aspects of the present invention.

FIG. 1 shows a first overhead view of an example device 1 for receiving tossed items and for storage of cooled items, with an angled top surface 5 of the device shown in a closed position, in accordance with aspects of the present invention. As shown in FIG. 1, the device 1 includes a top angled surface 5 having an opening 6.

Figure 2:
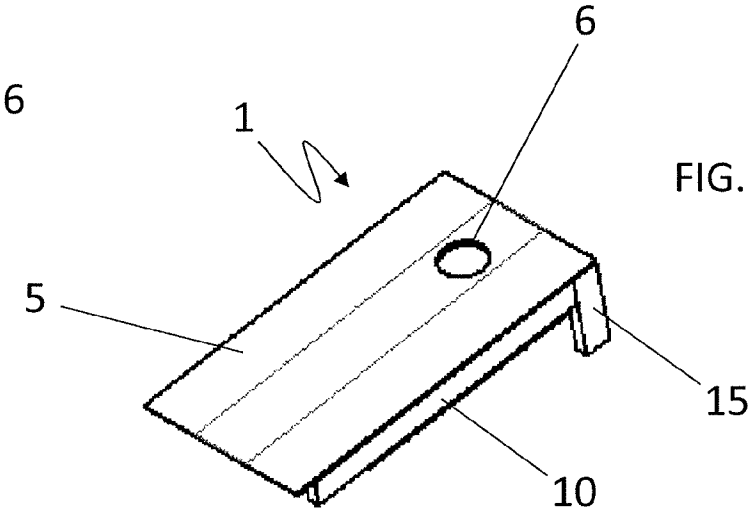
FIG. 2 shows a perspective view of the device of FIG. 1, with the angled surface in the closed position, in accordance with aspects of the present invention.

FIG. 2 shows a perspective view of the device 1 of FIG. 1, with the angled surface 5 in the closed position, in accordance with aspects of the present invention. The device 1 may further include one or more side supports 10 for the angled surface 5 of the device 1, and an angled support feature 15, such as a leg at one end of the device 1, for maintaining the top angled surface 5 at an angle.

Figure 3:
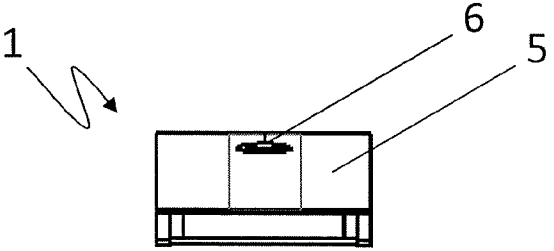
FIG. 3 shows a first end view of the device of FIG. 1, with the angled surface in the closed position, in accordance with aspects of the present invention.

FIG. 3 shows a first end view of the device 1 of FIG. 1, with the angled surface 5 in the closed position, in accordance with aspects of the present invention.

Figure 4:
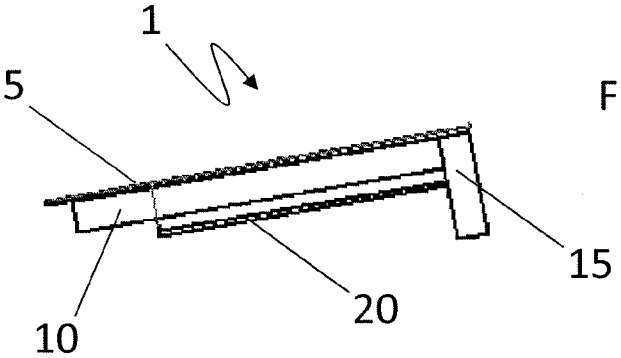
FIG. 4 shows a second end view of the device of FIG. 1, with the angled surface in the closed position, in accordance with aspects of the present invention.

FIG. 4 shows a second end view of the device 1 of FIG. 1, with the angled surface 5 in the closed position, in accordance with aspects of the present invention. Also visible are a side support 10 and the angled support feature 15, as well as a portion of the cooling container 20 (the cooling container 20 and/or the cooling container in combination with the side support 10 each interchangeably also being referred to herein as a "cooling housing").

Figure 5:
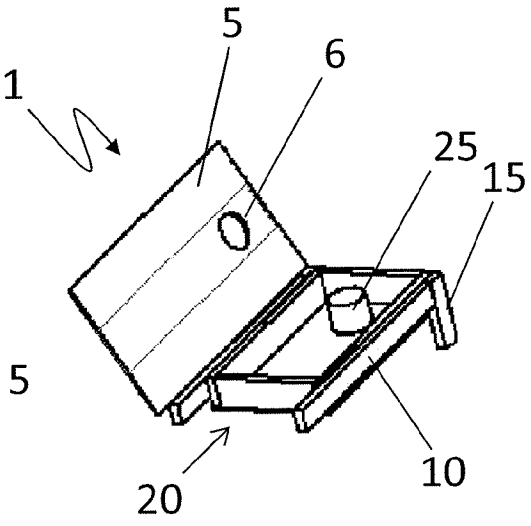
FIG. 5 shows a first perspective view of the example device for receiving tossed items and for storage of cooled items of FIG. 1, with the angled surface of the device shown in an open position, in accordance with aspects of the present invention.

FIG. 5 shows a first perspective view of the example device 1 for receiving tossed items and for storage of cooled items of FIG. 1, with the angled surface 5 of the device 1 shown in an open position, in accordance with aspects of the present invention. As shown, the device includes the cooling container portion 20, having sides and a bottom and secured to the supports 10, as well as a conduit 25 for communicating between the opening 5 and an opening in the bottom of the cooling container portion 20. While the conduit is shown in FIG. 5 as communicating between the opening 6 in the top surface 5 with the bottom of the device 1 when the top surface 5 is in a closed position, other variations may provide that the conduit communicate between the opening 6 (when top surface 5 is in the closed position) and another point, such as the side 10 and/or an end of the cooling container 20.

Figure 6:
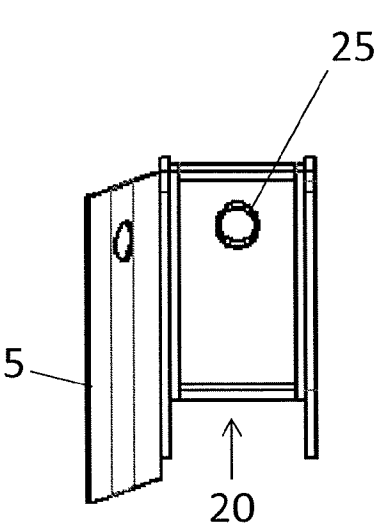
FIG. 6 shows an overhead view of the device of FIG. 1, with the angled surface in the open position, in accordance with aspects of the present invention.

FIG. 6 shows an overhead view of the device 1 of FIG. 1, with the angled surface 5 in an open position, in accordance with aspects of the present invention.

Figure 7:
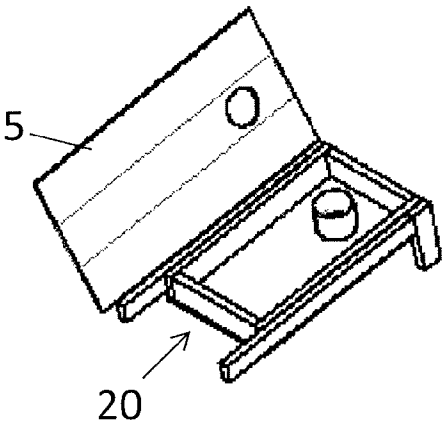
FIG. 7 shows a second perspective view of the device of FIG. 1, with the angled surface in the open position, in accordance with aspects of the present invention.

FIG. 7 shows a second perspective view of the device 1 of FIG. 1, with the angled surface 5 in an open position, in accordance with aspects of the present invention.

Figure 8:
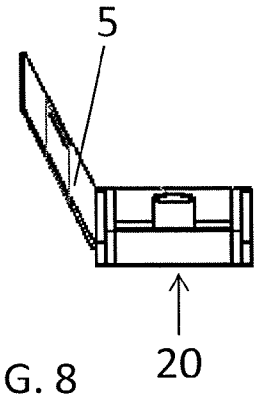
FIG. 8 shows an end view of the device 1 of FIG. 1, with the angled surface 5 in an open position, in accordance with aspects of the present invention.

FIG. 8 shows an end view of the device 1 of FIG. 1, with the angled surface 5 in an open position, in accordance with aspects of the present invention.

Figure 9:
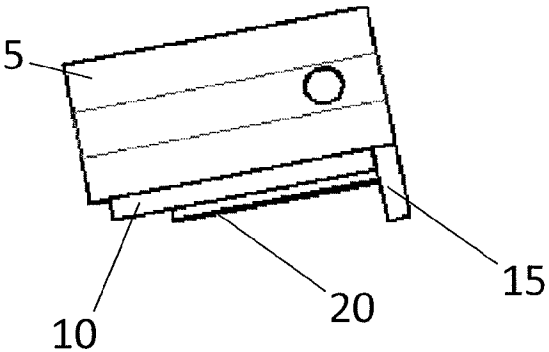
FIG. 9 shows a side view of the device of FIG. 1, with the angled surface in the open position, in accordance with aspects of the present invention.

FIG. 9 shows a side view of the device 1 of FIG. 1, with the angled surface 5 in an open position, in accordance with aspects of the present invention.

In one example implementation, the design of the device uses typical dimensions of the top angled surface for the game as used in the related art—a flat board (e.g., plywood) that is about 24"×48" and that is tilted roughly from about 3" above the ground in the front to about 12" above the ground at the back. There is also typically about a 6" diameter opening in the top angled surface that is centered in the narrow direction of the board and located about 9" from the higher end of the top surface. The top surface may be supported using one or more supports, such as legs and/or frame portions comprising 1"×6" or 2"×4" wood, for example. Aspects of the device may be attached to one another using various attachment features and methods, such as screws, nails, and/or glue.

In one example variation, the device of the present invention, in contrast with the related art, includes one or more hinges of other features that allow the top surface, or portion thereof, to pivot or be removed, so as to reveal an insulated cooler therebeneath. The cooler may be approximately 5.5" in depth, about 20" across, and about 32" in length, for example. The cooler portion may be constructed of a variety of materials, including wood, metal, or plastic, and may include an insulating material, such as foam insulating material located within the interior of the cooler portion.

A conduit, such as a polyvinyl chloride (PVC) pipe, may be incorporated into or operate with the cooler portion of the device, and be located relative to the opening in the top surface, such that when the items are thrown, and enter the opening in the top surface, the items fall straight to the ground (enabling retrieval), rather than entering the cooler portion.

Assembly for one example implementation in accordance with aspects of the present invention may occur as follows:

1. Wood sections (e.g., 1"×6" boards) may be cut to length so as to create the sides of the cooler portion;
2. Plywood (e.g., ¼" thick sheet) may be cut so as to form the bottom of the cooler portion; the sides and bottom may be attached to one another so as to form a box shape having sides and a bottom, with an open top;
3. Plywood (e.g., ½" thick sheet) may be cut so as to form the 24×48" top angled surface portion, and a 6" hole may be cut at the appropriate location on the top angled portion;
4. Wood sections (e.g., 2"×4" boards) may be cut to make the legs and the supports; legs may be attached on the sides of the cooler portion so that the 4" side of the 2"×4" is flat against the cooler portion and flush with the back corner and the top of the cooler; wood sections may be cut so that their ends contact the ground flatly, rather than having a corner dig into the ground;
5. An opening may be cut in the cooler so that when the PVC pipe is added, the pipe is aligned with the opening that was cut for the top board, and the pipe extends through the cooler;
6. The PVC pipe may be down to the appropriate length to extend from the top portion and through the cooler portion, and the pipe may be attached to the bottom of the cooler portion using, for example, glue;
7. Insulating material may be cut so that it fits along the inside of the cooler, sized to ensure the cooler portion is watertight, and/or additional material (e.g., waterproof caulk) may be added such that the joints and the opening for the PVC pipe are leak-proof or water resistant;
8. Hinges or other suitable features may be attached to either side of the top angled surface portion (hinges may allow opening in any suitable direction).

Optionally, additional features may be added:

9. Handles may be added to the side(s), such as the sides with the hinges, to enable easy carrying of the device; and
10. The device may be painted and/or decorated, such as with team colors, logos, etc.

Although example aspects of the present invention have now been discussed in accordance with the above advantages, it will be appreciated by one of ordinary skill in the art that these examples are merely illustrative and that numerous variations and/or modifications may be made without departing from the spirit or scope hereof.

The invention claimed is:

1. A device for providing cooling and for playing an item toss game, the device comprising:

a plurality of wall sections and a bottom section defining an undivided internal portion, the undivided internal portion consisting of a cooling housing, wherein the cooling housing has an interior surface and an insulating material located on at least a portion of the interior surface;

a top cover attached to the cooling housing, the top cover having a top cover opening, the top cover being configured to selectively allow access to the interior of the cooling housing;

a conduit attached to the cooling housing, the conduit being positioned so as to communicate the cooling housing opening with the top cover opening, wherein the conduit extends from the top cover opening through the cooling housing to an opposite opening in the bottom section; and at least one support interconnectable with the cooling housing so as to angle the top cover relative to a supporting surface.

2. The device of claim 1, wherein the conduit is configured to direct an item received in the top cover opening to a location external to the device via the interior of the conduit.

3. The device of claim 1, wherein the cooling housing opening is located in the bottom of the cooling housing.

4. The device of claim 1, wherein the cooling housing opening is located in one of the plurality of wall sections.

5. The device of claim 1, wherein the cooling housing further comprises:

at least one side support;

wherein the cooling housing is attached to each of the at least one side support.

6. The device of claim 5 the device further comprising:

insulating material abuttably located on at least a portion of the interior surface of the cooling housing portion.

7. The device of claim 1, wherein the top cover is attached to the cooling housing via at least one hinge, and wherein the top cover is configured to allow access to the interior of the cooling housing via opening of the cover via the at least one hinge.

8. The device of claim 1, wherein the conduit extends from the top cover opening through the cooling housing to an opposite opening in the bottom section via a linearly axially extending path from the top cover opening to the opposite opening.

9. A device for providing cooling and for playing an item toss game, the device comprising:

an undivided housing comprising a plurality of wall sections and a bottom section, the bottom section having a bottom section opening;

a top cover attached to the housing, the top cover having a top cover opening, the top cover being configured to selectively allow access to the interior of the housing;

a conduit attached to the housing, the conduit being positioned so as to communicate the bottom section opening with the top cover opening, wherein the conduit extends from the top cover opening in a linearly axially extending path through the housing to the bottom section opening; and at least one support interconnectable with the housing so as to angle the top cover relative to a supporting surface;

wherein the interior of the housing consists of a cooler portion; and wherein the conduit is configured to allow an item tossed thereinto to pass through the cooler portion to an open space beneath the device, such that the item may be retrieved without accessing the interior of the housing.

10. A method of using a device for playing an item toss game and for providing cooling, the device comprising a plurality of wall sections and a bottom section defining an undivided internal portion, the undivided internal portion consisting of a cooling housing, wherein the cooling housing has an interior surface and an insulating material located on at least a portion of the interior surface;

a top cover attached to the cooling housing, the top cover having a top cover opening, the top cover being configured to selectively allow access to the interior of the cooling housing;

a conduit attached to the cooling housing, the conduit being positioned so as to communicate the cooling housing opening with the top cover opening, wherein the conduit extends from the top cover opening through the cooling housing to an opposite opening in the bottom section; and at least one support interconnectable with the cooling housing so as to angle the top cover relative to a supporting surface, the method comprising:

storing at least one item to be cooled in the cooling housing for later retrieval;

playing the item toss game, the item toss game including:

tossing an item toward the device; and if the item is received within the top cover opening, the conduit directing the item to a location external to the device.

11. The method of claim 10, wherein playing the item toss game further comprises:

providing a score if the item is received within the top cover opening.

12. The method of claim 10, further comprising:

retrieving the at least one item to be cooled from the cooling housing.

13. The method of claim 12, wherein the at least one item to be cooled is a beverage.

14. A method of constructing a device for providing cooling and for playing an item toss game, the method comprising:

attaching a top cover over an undivided internal portion, the undivided internal portion consisting of a cooling housing, the cooling housing including a plurality of wall sections and a bottom section having a cooling housing opening, wherein the top cover has a top cover opening, the top cover being configured to selectively allow access to the interior of the cooling housing, and wherein the cooling housing has an interior surface and an insulating material located on at least a portion of the interior surface;

emplacing a conduit in a location to communicate the cooling housing opening with the top cover opening; and attaching at least one support to the cooling housing, the at least one support being configured to angle the top cover relative to a supporting surface.

15. The method of claim 14, further comprising:

assembling the cooling housing.

16. The method of claim 15, wherein the cooling housing includes a bottom section and four side sections, and wherein assembling the cooling housing includes attaching each of the four side sections to the bottom housing.

17. The method of claim 14, wherein the conduit extends in a linearly axial path from the cooling housing opening to the top cover opening.

* * * * *